US005441211A

United States Patent [19]

Ueda et al.

[11] Patent Number: 5,441,211

[45] Date of Patent: Aug. 15, 1995

[54] METHOD AND APPARATUS FOR UNINTERRUPTED WINDING OF A CONTINUOUS SHEET ONTO A SUCCEEDING SPOOL

[75] Inventors: Takashi Ueda, Nishinomiya; Itsuo Fuki, Amagasaki, both of Japan

[73] Assignee: Kanzaki Seishi Co., Ltd., Tokyo, Japan

[21] Appl. No.: 78,454

[22] Filed: Jun. 16, 1993

[30] Foreign Application Priority Data

Jun. 19, 1992 [JP] Japan ..... 4-160966

[51] Int. Cl.[6] ..... B65H 19/26; B65H 19/28

[52] U.S. Cl. ..... 242/526.1; 242/527.3; 242/532.2; 242/532.3; 242/542.3

[58] Field of Search ..... 242/527, 527.3, 532.2, 242/532.3, 542.3, 526.1, 541; 156/504, 157

[56] References Cited

U.S. PATENT DOCUMENTS 3,889,892 6/1975 Melead ..... 242/527.3

4,601,441 7/1986 Oinonen et al. ..... 242/527.3

*Primary Examiner*—John Q. Nguyen

*Attorney, Agent, or Firm*—Schweitzer Cornmann & Gross

[57] ABSTRACT

In a process and apparatus for winding a continuous webbing onto a windup spool wherein a webbing is fed from a supply direction to a rotatable feed drum, winding the webbing onto the feed drum, contacting the feed drum with a first windup spool for frictional rotational engagement therewith, when said first windup spool has a predetermined amount of webbing wound thereon ripping apart the webbing by forming a rip therein with the discharge pressure of a blast of air, and detaching the first windup spool from the engagement with the feed drum, the ripping of the webbing forming a leading edge at the rip in the webbing from the supply direction, winding the leading edge on a second windup spool, in that prior to the ripping, and at a location of the webbing when viewed from the supply direction before the second windup spool establishing rotational contact between the center of the webbing and a slitting wheel having a lateral slitting knife and an adhesive mounted thereon, rotating the slitting wheel in contact with the webbing, forming a slit in the center of the webbing to facilitate the subsequent ripping, attaching the adhesive to the webbing at a location when viewed from the supply direction before the slit, and after the ripping apart of the webbing by the air blast, adhering with the adhesive the leading edge of the rip in the webbing to the second windup spool.

15 Claims, 6 Drawing Sheets

METHOD AND APPARATUS FOR UNINTERRUPTED WINDING OF A CONTINUOUS SHEET ONTO A SUCCEEDING SPOOL

FIELD OF THE INVENTION

The present invention is directed to an improvement in a winding station of a paper making system, and particularly relates to a method and apparatus for winding a supplied continuous sheet of paper web without interruption onto a second spool in place of a first spool which has a predetermined amount of the supplied sheet already wound thereon.

BACKGROUND OF THE INVENTION

A conventional paper making system comprises a paper forming station for forming a paper web, a coating station for applying a layer of coating material onto the paper web, and a winding station for winding the supplied web onto a spool.

A type of winder is usually employed in the winding station with a horizontal rail frames (referred hereinafter as the "winder"). A paper web is advanced continuously by a feed drum and around a part of the periphery of the feed drum to a windup spool, and is then wound onto the windup spool into a roll. The windup spool contacts the feed drum with frictional rotation, the drum being driven by a drive mechanism. Thus the spool is rotated by the rotating feed drum. When the paper web wound onto the windup spool has a predetermined amount of webbing wound thereon, the supplied paper web is then wound onto a second, a succeeding new windup spool which then replaces the filled up first spool. The second windup spool is maintained in a standby position and is held by pivotable primary arms at a higher level than the feed drum. As the lowering of the primary arms bring the succeeding spool 2*b* into contact with the feed drum 1, the paper web is ripped along its width by the pressure of a blast of air discharged tangentially to the feed drum 1 so that the ripped following end of the oncoming paper web supply is blown upwardly and is wound onto the second, the succeeding windup spool. The paper webbing wound up onto the first windup spool is transported by a returnable secondary arm which supports the first spool away from where it was wound with the webbing and then the second spool is lowered onto the horizontal rails and is handed over to the secondary arm while it is in frictional, rotating contact with the feed drum.

This technique of ripping the supplied paper web by the air blast produces irregularly shaped ripped paper sections so that the ripped starting edge of the following paper webbing is likely to be folded and then overlapped. This means that the satisfactory winding up of the ripped starting edge onto the second windup spool is not assured because the folded and overlapped edge of the paper web results in an irregular wound up roll that can be deformed at its edges or produces an irregular running out of the wound up paper web due to position deviation. As a result, a finished roll can have relatively numerous poorly wound parts.

The aforementioned known technique, requires long time period to wind the paper web onto the second windup spool if the paper web is too difficult to rip or is so soft that it would be torn at a part which follows the ripped edge wound onto the second windup spool. In such cases which take too much time to wind the paper web that is continuously supplied must be taken away to minimize loss and/or damage, and the required additional labor results in a loss of productivity of rolls of paper webbing.

In view of the aforementioned disadvantages, there was previously proposed an improved technique to enable a regular ripping of the supplied paper web by a discharged air blast, combined with making a transverse slit in the center part of the paper web upstream of the feed drum, and then discharging the air blast onto the slit, as shown in Japanese publication H1-129163 of Japanese utility model application S63-25852 filed Feb. 27, 1988. According to that improved, simplified technique, particularly where a wheel with a slitting knife provided thereon is used to make a lateral slit in the paper web. A slitting wheel is adapted to rotate in contact with the paper web, so that a slitting knife provided on the slitting wheel makes a lateral slit in the paper web, and the discharge of the air jet rips the paper web suitably in a desirable sectional outline.

Even with the improved technique for making a slit in the paper web with a slitting knife, it is not possible smoothly to wind paper web, without folding and overlapping particularly when the paper web is a sheet of relatively stiff paper coated with a layer of thick coating material.

SUMMARY OF THE INVENTION

It is one object of the present invention to overcome the aforementioned draw backs by providing a method and apparatus having a simplified arrangement to ensure a desired ripping by a blast of air and the uninterrupted and smooth winding onto a second windup spool without folding and overlapping, even a continuous sheet of relative hard paper web or film.

It is another object of the present invention to provide a method and apparatus for the uninterrupted winding of a continuous sheet of paper web onto a second windup spool, which can reduce a cost of installation with a simplified arrangement, and enhance the functionality and reliability of the process and apparatus by utilizing a slitting wheel adapted to be rotated by the continuous webbing as is it forwarded in combination with a means for making a lateral slit in the paper web, and a means for applying an adhesive substance to the sheet after the resultant slit and to ensure the making of a slit in the sheet and the applying of the adhesive substance to the sheet while the slitting wheel is rotated by contact with the forwarded webbing. Thus any unexpected tearing of the webbing due to an excessive force can be avoided before the sheet is ripped, starting from the fixed slit. Deviations will not occur in the shape and the direction of the rip and the adhesive substance can be easily applied as desired.

The invention provides a method and apparatus for the interrupted winding of a continuous paper webbing onto a second windup spool which, in combination with a slitting having a lateral slitting knife and an adhesive element at the rear of the knife on an external periphery of the wheel and disposed vertically movably disposed manner upstream of a second windup spool awaiting use, and over a central part of the supplied webbing comprising causing the splitting wheel to contact the webbing and rotate and make a slit in it before the blast of air rips the webbing, and transferring the adhesive element from the slitting wheel onto the webbing behind the slit.

According to that arrangement, when the continuous sheet of paper webbing is uninterruptedly wound onto the second windup spool, the slitting wheel is lowered and contacts the webbing before the discharge of the air blast for ripping the sheet, so that the slitting wheel rotates in contact with the webbing as the slitting knife on the wheel plunges into the webbing and makes a slit in the sheet. The adhesive substance transferred from the slitting wheel to the rear of the slit in the sheet. Next, the discharge of the air blast into the slit of the sheet forces the sheet to rip from both the opposite ends of the slit toward both the sides of the webbing with the ripped starting edge of the webbing being formed into an isosceles trapezoid. Since the adhesive substance is transferred to the webbing in close to the ripped starting edge of the webbing is attached to the second windup spool, so that the webbing is now wound up onto the rotated second windup spool in a trouble free, smoothly continuous manner.

As used throughout the specification and the claims, any reference to "paper" is intended to encompass any other film webbing which can be processed in accordance with the present invention.

DESCRIPTION OF THE DRAWING

For more complete understanding of the new and improved method of the present invention, and for a better appreciation of the advantages to be derived from the new method and the improved apparatus of the present invention, reference is made to the following detailed description of the invention, with reference to the accompanying drawings, wherein.

DETAILED DESCRIPTION

Figure 1:
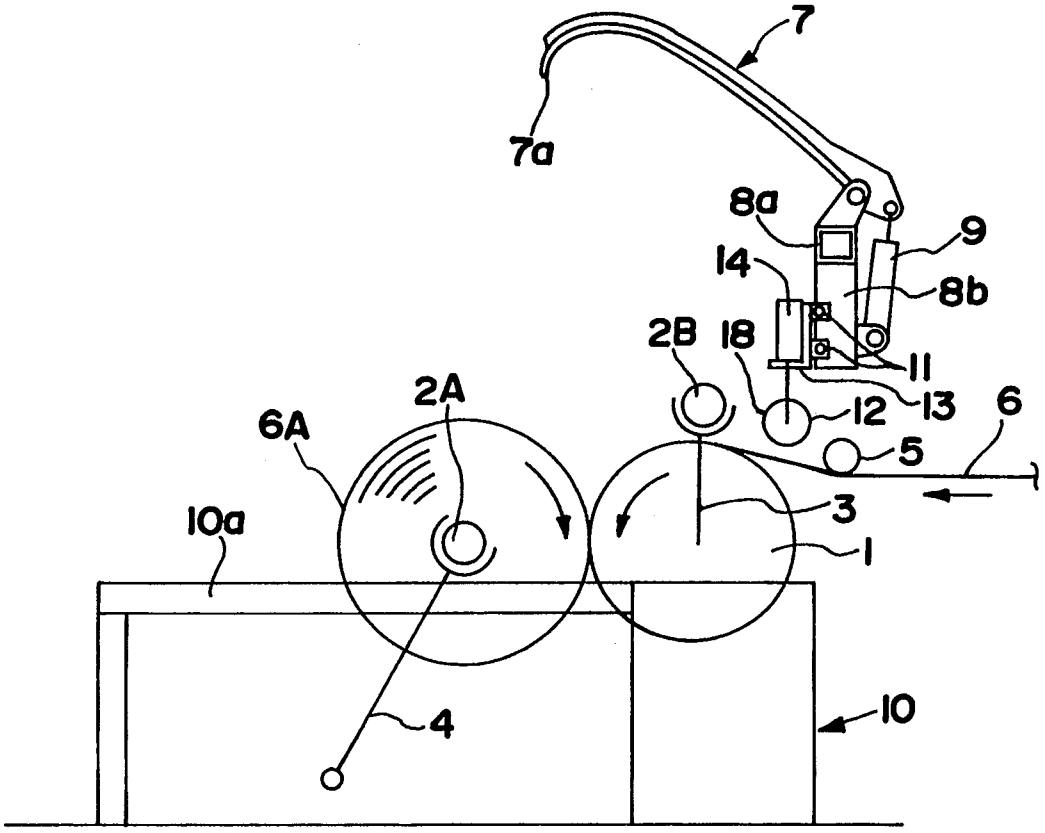
FIG. 1 is a diagrammatic side view of a horizontal rail framework type winder employing the present invention, wherein a succeeding spool is on standby.
Figure 2:
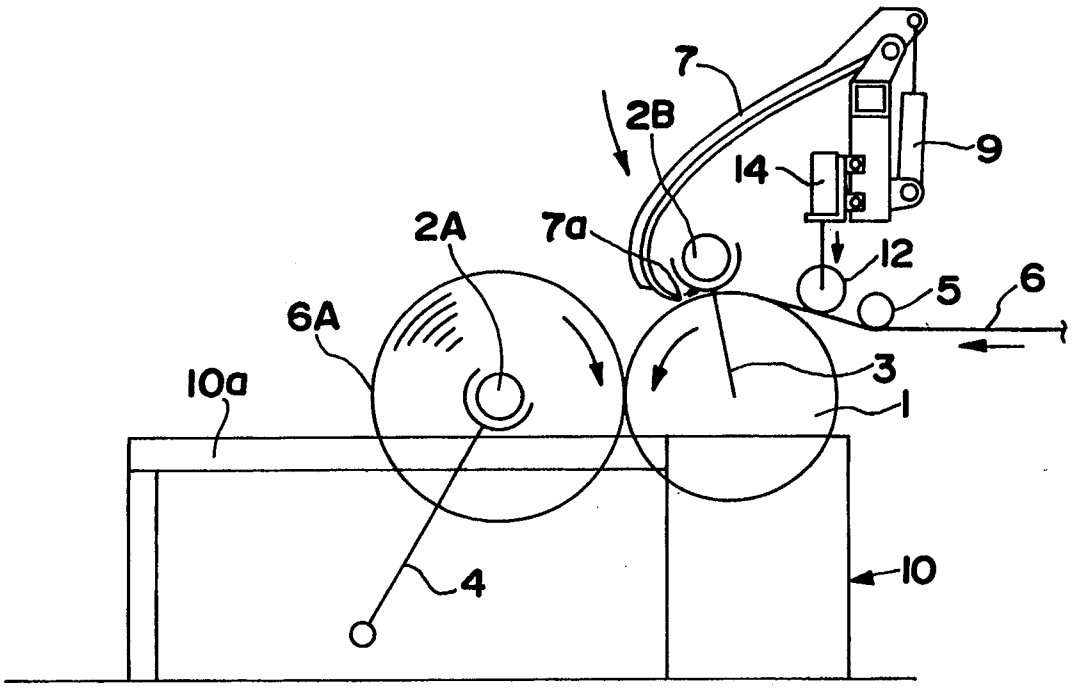
FIG. 2 is a diagrammatic side view of the same winder as in FIG. 1, showing the succeeding spool in operation.

FIGS. 1 to 4 show a first embodiment of a horizontal rail framework type of winder employing the present invention. In FIGS. 1 and 2, a base stand 10 has a framework of horizontal rails 10*a* extended in the downstream direction. A rotatable feed drum 1 is connected with a drive mechanism (not shown) for rotation, to advance a continuous sheet of paper webbing 6 supplied from upstream at a constant speed. A spool 2A is rotatably supported across the horizontal rails 10*a* and is pushed against the feed drum 1 by secondary arms 4, so that the spool 2A is rotated by the rotation of the feed drum 1 by contact therewith while the paper web 6 supplied from upstream passes through the feed drum 1 and is then wound onto the first windup spool 2A to form a roll 6A. The spool 2A is rotated clockwise by the counterclockwise rotation of the feed drum 1. A second windup spool 2*b* is supported by primary arms 3 pivotally supported from both sides of the feed drum 1, and above the feed drum. A guide roller 5 is provided for the adjustment of the path of the paper web 6 supplied to the feed drum 1.

An air blower 7 is disposed above the feed drum 1, and comprises an arcuate tube projecting downstream and having a nozzle 7*a* at the projecting edge through which a blast of air is discharged at high pressure. The air blower 7 is pivoted from a horizontal frame 8*a* the width of which is bridged above the guide roller 5. The main body of the blower 7 has a wide portion retained with a pivot 8*c* on a fixed bracket secured to the horizontal frame 8*a* and has a bottom portion connected to a hydraulic cylinder 9 mounted from a fixed bracket. The tube of the blower 7 is maintained in an upright normally inactive position, as shown in FIG. 1. In its active position the blower 7 is tilted downwardly by the actuated piston rod of the cylinder 9 with its nozzle 7*a* pointing across the top of the feed drum 1, as shown in FIG. 2.

A slitting wheel 12, adapted to slit the paper webbing 6 across its width, is rotatably connected with and suspended from a slider mount 13 disposed over the paper web 6 between the succeeding spool 2B and the guide roller 5. Also shown in FIGS. 3 and 4, the slitting wheel 12 is suitably made from a lightweight aluminum alloy, and has a slitting knife 18, shaped like saw teeth, provided laterally across the slitting wheel on an external round face 12*a* thereof. The surface of the slitting wheel is suitably covered with a rubber sheet and the slitting knife 18 has an edge inclined toward the clockwise rotational direction of the slitting wheel 12 from the radial direction. An arcuate rest plate 19 is disposed on the surface 12*a* of the slitting wheel 12 after knife 18 in the direction of rotation, and a pressure sensitive adhesive double coated tape 20 is placed upon the resting plate 19. Spike pins 21 are provided on the surface 12*a* of the wheel 12 peripherally remotely from the knife 18. A weight 22 is mounted on the inside of the slitting wheel 12 after the resting plate 19 in the direction of rotation is shown in FIG. 4, so that the weight defines the position of the slitting wheel when it is free to rotate by itself.

Figure 3:
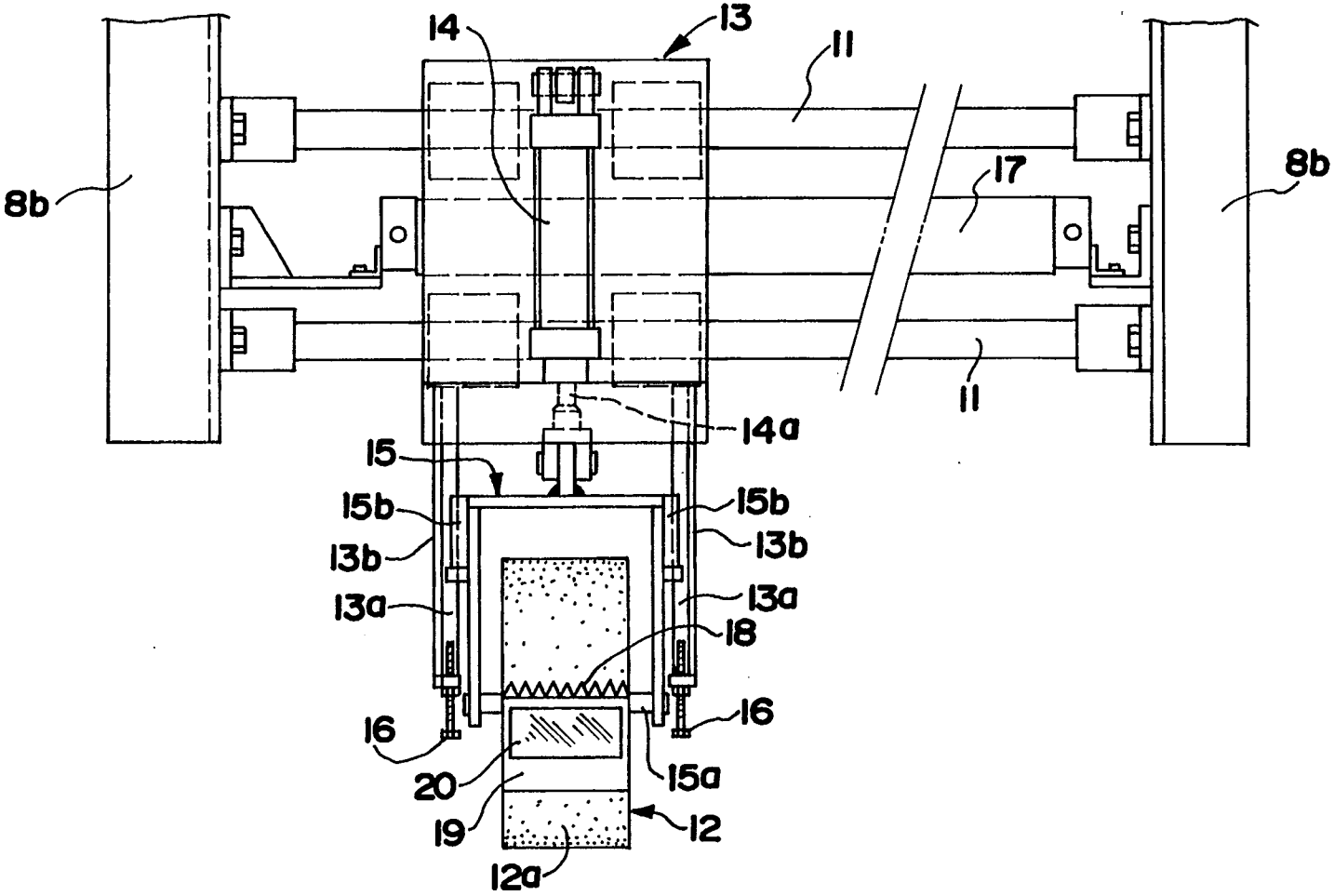
FIG. 3 is a front elevational view of a slitting mechanism with a rotating wheel in the winder of FIG. 1.

As shown in FIGS. 1 and 2, the slider mount 13, over the supplied paper web 6 between the second windup spool 2B and the guide roller 5, is mounted movably from a pair of parallel horizontal bars 11 bridged between vertical frame members 8*b* which are combined with both the sides of the horizontal frame members 8*a*. The slider mount 13 as shown in FIGS. 3 and 4 includes a wheel holder 15 having a reverse U shape which supports the slitting wheel 12 with a lateral shaft 15*a* for free rotation. A hydraulic cylinder 14 has a vertical piston rod 14*a* connected to the wheel holder 15 to enable vertical shifting of the slitting wheel 12. Guide plates 13*b* are arranged on both sides of the wheel holder 15, and are provided with an inward guide rail 13*a*. The wheel holder 15 is provided on both exterior sides with a channeled block 15*b* which straddles the inward guide rails 13*a* of the guide plates 13*b*. This arrangement enables the up and down shifting of the slitting wheel 12 between the second windup spool 2B and the guide roller 5 above the supplied paper 6. The slider mount 13 is connected for lateral movement to a hydraulic actuator 17 between the parallel horizontal bars 11.

Figure 4:
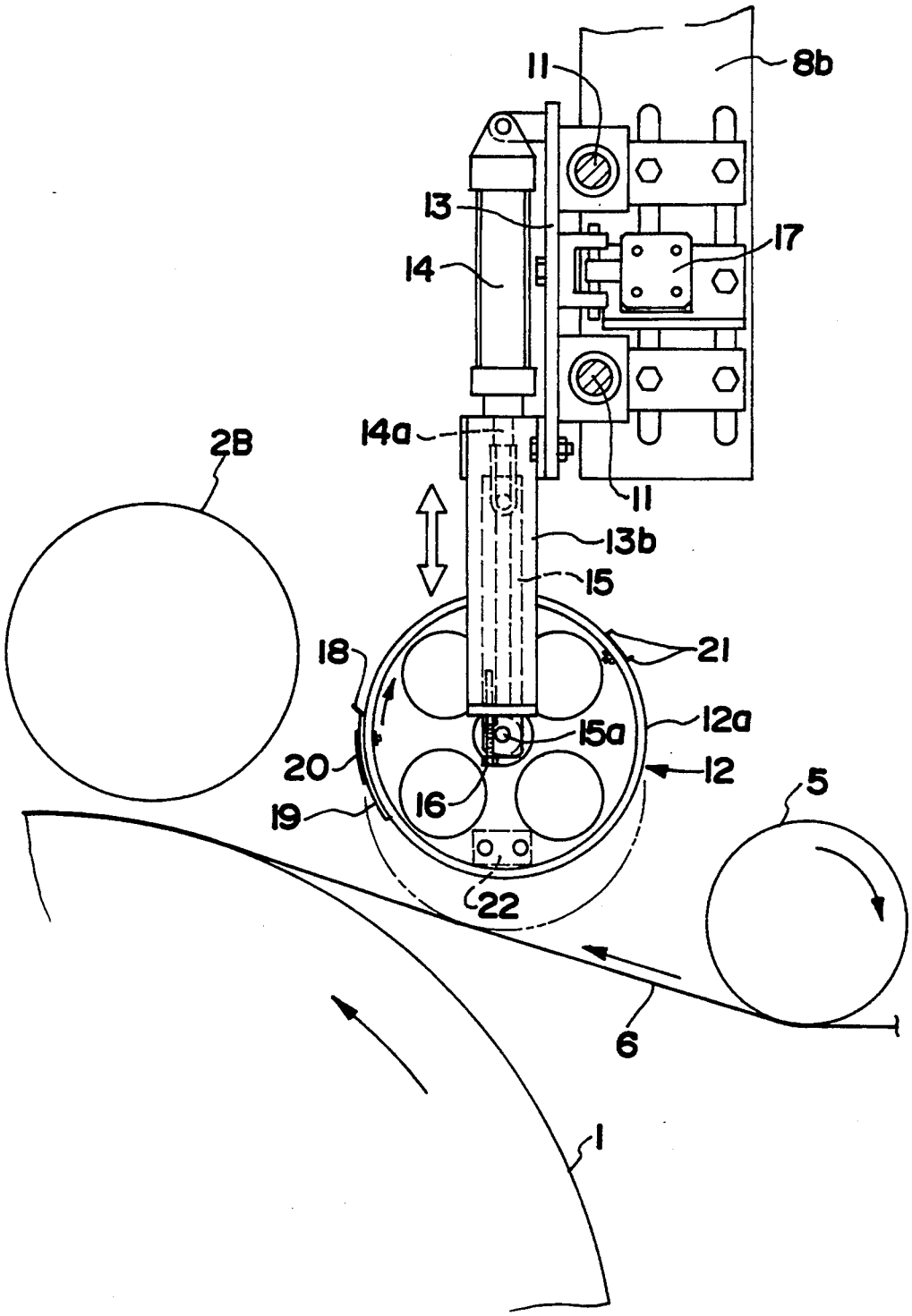
FIG. 4 is a side elevational view of the slitting mechanism of FIG. 3.

Adjustable stopper bolts 16 is provided at the lower ends of the guide plates 13*b* for providing a lower limit to the travel of the wheel holder 15 or the slitting wheel 12 when the lowered slitting wheel 12 contacts the paper web 6, as shown in FIG. 4 in a broken line.

Soon after its downward shift to contact the paper web, the slitting wheel 12 is lifted up by the predetermined timer setting. The wheel 12 may make some rotations during the contact with the paper web while the knife 18 may make further slits in the paper web, but the continued blowing of air from the blower 7 causes the part of the paper web following the ripped leading edge to hover partially over the feed roller 1. Thus the discharged air directs the paper web 6 to being wound up on the second windup spool 2B, so that the paper web will not be ripped as a result of the further slits.

The roll 6A of the paper web on the first windup spool 2A having reached a predetermined size is then conveyed downstream along the horizontal rails 10*a* and is removed such as by a winch. The second windup spool 2B, onto which the paper windup has began with the ripped leading edge of the supplied webbing, is lowered onto the horizontal rails 10*a* by the forward turning of the primary arms 3, and is handed over to the secondary arms 4 while the succeeding spool 2B remains in frictional rotary contact with the feed drum 1. Similarly to the first windup spool 2A, the second windup spool 2B is pushed against the feed drum 1 by the secondary arm 4 for dependently rotation thereby.

Figure 6:
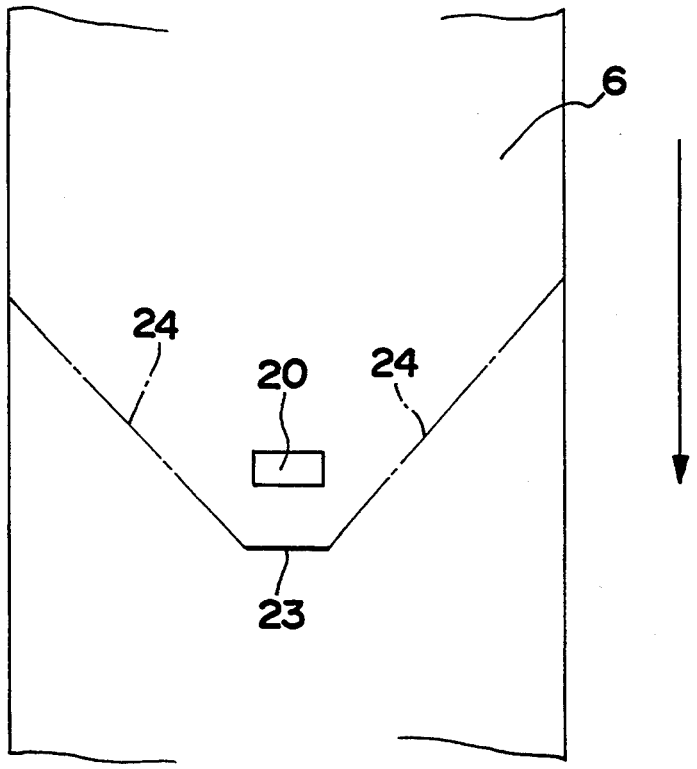
FIG. 6 is a plan view of the supplied paper web to be ripped by blast of air.

The slitting wheel 12 is in its raised standby position over the center of the supplied paper web 6 passing through between the second windup spool 2B and the guide roller 5. An adhesive double coated tape 20 is applied to the resting plate 19 of the slitting wheel 12 that can be moved sideways on the horizontal guide bars 11. In this manner, when the paper web wound on the first windup spool reaches a predetermined roll size the second windup spool 2B on standby is brought into frictional rotational contact with the feed drum 1 by the tilting of the primary arms 3, as shown in FIG. 2. The weight 22 in at the lowest point of the freely rotating slitting wheel 12. The slitting wheel is lowered onto the supplied paper web 6 by the actuating piston rod of the cylinder 14, and the wheel starts to be rotated by contact with the forwarded paper web 6. The spike pins 21 pierce the paper web 6 to synchronize the rotation of the slitting wheel 12 with the forwarding of the paper web 6. Then, the lateral slitting knife 18 plunges into the paper web 6 and the adhesive double coated tape 20 is transferred from the resting plate 19 onto the paper web 6 after the lateral slit in the central zone of the paper, as shown in FIG. 6, and has the adhesive double coated tape 20 applied to a position following the slit 23.

The tube of the air blower 7 is tilted downwardly by the actuated rod of the cylinder 9, with its nozzle directed across a top portion of the feed drum 1. In this manner, the air blast is discharged at high pressure from the nozzle 7*a* of the blower 7 to the slit 23 of the supplied paper web passing through the slitting wheel 12, so that the paper web 6 is ripped from the opposite ends of the slit 23 in a rearwardly oblique direction toward both sides of the paper web and thereby its ripped section is formed into an isosceles trapezoid. The leading edge of the rip of the following supplied paper web is blown upwardly off the feed drum 1 and the adhesive double coated tape 20 adheres to the second windup spool 2B, so that the supplied paper web 6 is drawn successively by and wound onto the second windup spool 2B without the end of the paper web 6 being folded and overlapped.

Thus the leading edge of the ripped paper web is formed into an isosceles trapezoid flatter than in accordance with the prior art, or is sometimes formed into a rectangle as a result of being ripped along the slit 23. However, even in such occasional occurrences the winding up of the paper web 6 on the second windup spool 2B is performed smoothly. More particularly, the leading edge of the paper web being formed into a flatter isosceles trapezoid, is wound satisfactorily on the second windup spool 2B while the parts following the slit 23 in the supplied paper web touch the spool 2B throughout its width. Accordingly, even when further slits are made in the webbing, as described above, the paper will not rib from those further slits.

The adhesive element of the double coated tape is manually applied to the external surface of the slitting wheel 12 by the operator each time the winding of the paper web on to the first spool comes to an end. However, it is possible to apply the adhesive element to the slitting wheel efficiently by an automatic apparatus (not shown). Instead of the pressure sensitive adhesive double coated tape 20, a liquid adhesive substance can be used as an adhesive element which is transferred from the slitting wheel 12 onto the paper web 6.

Whereas the above-described mounting of the slitting wheel permits its lateral sliding on the horizontal bars 11, but the slitting wheel 12 can also be mounted only vertically shiftably over the center of the webbing without lateral movability. The slitting wheel 12 can be moved vertically by any suitable actuation instead of hydraulic cylinder with a piston rod.

Figure 5B:
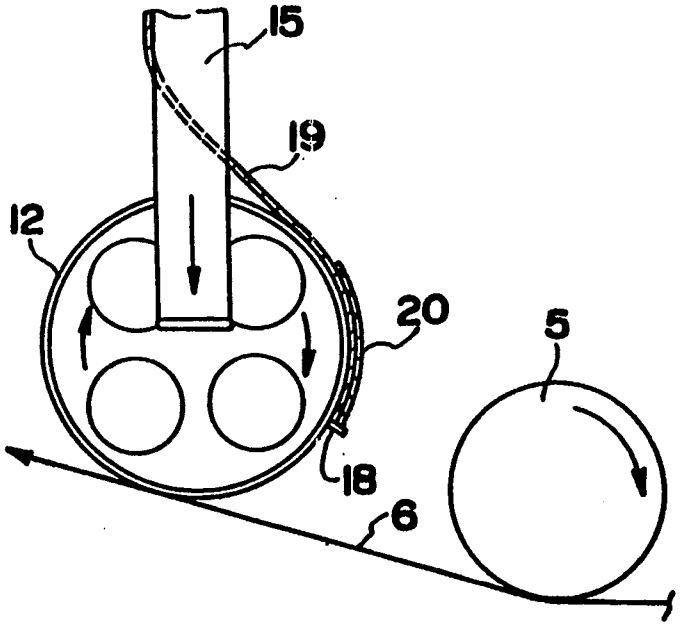
FIGS. 5(*a*) and 5(*b*) are side views showing a second embodiment of the winder of the present invention, with a raised (FIG. 5(*a*)) and a lowered (FIG. 5(*b*)) wheel holder.
Figure 5A:
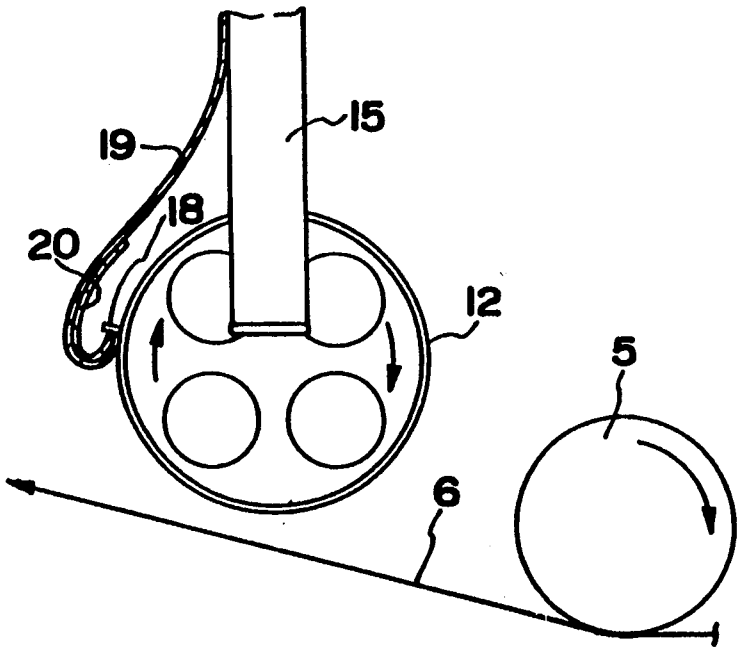

In another embodiment of the present invention shown in FIG. 5, a pressure sensitive adhesive double coated tape 20′ is applied to the slitting wheel 12′ in a different manner. An assistant rest sheet 19′ having a relatively great length is used in place of the assistant rest plate 19 of the first embodiment. The assistant rest sheet 19′ is mounted in a loosely bent manner with one end attached as shown particularly in FIG. 5(*a*), to the slitting wheel 12′ just after the slitting knife 18′ located to come into contact with the webbing, with the other end of the assistant rest sheet 19′ being anchored temporarily with a fastener to the wheel holder 15′ of the slitting wheel 12′ at a position remote from the slitting wheel.

In this arrangement, the wheel holder 15′ is lowered as shown in FIG. 5(*b*), so that the slitting wheel 12′ is brought into contact with the supplied paper web 6 while being rotated clockwise. The lateral slit is made by the slitting knife 18 in the central zone of the supplied paper web 6 and the adhesive double coated tape 20′ is transferred from the slitting wheel 12 to the paper web 6 after the slit was made. As the slitting wheel 12′ rotates, the upper end of the assistant rest sheet 19′ which was temporarily attached to the wheel holder 15′, becomes detached therefrom and is then drawn around the external surface of the slitting wheel 12.

The slitting wheel 12′ in the described embodiment of the present invention rotates by frictional contact with the forwarded paper web, but the rotating wheel 12′ can be arranged to rotate independently of the forwarded paper web. Accordingly, the slitting wheel 12 can also be rotated before contact with the paper web, by an air blown drive impeller or any other rotation drive mechanism, with the intent being to lessen any shock of contact between a stationary slitting wheel 12′ and the paper web 6, or to smooth the slitting function of the slitting knife 18′ and the transfer of the adhesive substance to the supplied paper web by synchronizing the rotational speed of the slitting wheel 12' with the forwarding speed of the paper web.

The second embodiment of the present invention employing the elongated assistant rest sheet 19' can have an advantage over the first embodiment in which the adhesive coated tape 20 is applied directly to the external surface of the slitting wheel 12. More particularly, in the first embodiment, there is a limitation on the length of the adhesive coated tape 20, so that the transfer of the adhesive coated tape 20 onto the supplied paper web 6, cannot always be successfully completed when the slitting wheel 12 contacts with the paper web 6 forwarded at high speed and is thus too swiftly rotated before the adhesive coated tape 20 can touch the paper web 6 sufficiently. On the other hand, the improved arrangement of the second embodiment is adapted to bring an adhesive coated tape 20' of a relative great length into contact with the paper web 6 so that the transfer of the adhesive coated tape 20' onto the supplied paper web 6 can be completed positively even when the supplied web 6 is forwarded at high speed and the rotating wheel 12' rotates swiftly.

In accordance with the present invention the slitting wheel rotates together with the forward movement of the paper web and thus the slitting by the knife and the transfer of the adhesive element are performed in relation to the moving paper web. Therefore, advantageously this activity can be carried without a separate rotating drive mechanism and control mechanism for the slitting wheel to reduce the cost of installation.

In the present invention the spike pins pierce the paper web to synchronize the rotation of the wheel with the forwarding speed of the paper web. Therefore, it is possible to perform the slitting and the transfer of the adhesive element in a steadier manner. Even when the paper web is forwarded at a relatively high speed, the adhesive element is transferred to the paper web at a position near behind the slit, so that the ripped leading edge of the following paper web is smoothly attached to the second windup spool.

The provision of the weight on the slitting wheel causes the slitting knife and the adhesive element to make one rotation substantially after the wheel comes into contact with the paper web. Therefore, the slitting knife plunges into the paper web without a sliding and then make the required slit in the paper web by the time the rotation of the wheel becomes synchronized with the forwarding speed of the paper web.

According to the second embodiment of the invention shown in FIG. 5, the slitting wheel rotates swiftly due to the contact with the paper web forwarded at high speed, it is possible to place the relatively long adhesive coated element at a position suitable to synchronize the forwarding speed of the paper web with the rotational speed of the slitting wheel. Thus even when the supplied paper web is forwarded at high speed, the adhesive coated tape can be transferred reliably to the paper web, just after the plunging of the slitting knife into the paper web.

The embodiment of the present invention suitably employs a pressure sensitive adhesive double coated tape as an adhesive element, so that the application of the adhesive element to the rotating wheel can be easily performed while the transfer of the adhesive element to the paper web can be reliably completed. The attachability of the leading edge of the paper web to the second windup spool is thus enhanced to prevent the paper web from folding and overlapping.

The complete scope of the invention is defined by the following claims.

We claim:

1. In a process for winding a continuous webbing onto a windup spool, which comprises supplying from an upstream supply direction the continuous webbing into contact with a rotatable feed drum, contacting said feed drum with a first windup spool for frictional rotational engagement therewith, winding the webbing onto said first windup spool, when said first windup spool has a predetermined amount of webbing wound thereon, ripping apart the webbing by forming a rip therein with the discharge pressure of a blast of air, and detaching said first windup spool from said engagement with said feed drum, said ripping of said webbing forming a leading edge at the rip in the webbing from the supply direction, winding said leading edge on a second windup spool, the improvement which comprises prior to the ripping, and at a location of the webbing when viewed from the supply direction upstream of the second windup spool, establishing contact between the lateral center of the webbing and a slitting wheel having a lateral slitting knife and an adhesive mounted thereon, rotating the slitting wheel by contact with the webbing, forming a slit in the center of the webbing with the knife to facilitate the subsequent ripping, transferring said adhesive to said webbing at a position when viewed from the supply direction upstream of said slit, and simultaneously with the ripping apart of the webbing by the air blast directed at said slit, blowing the leading edge with the adhesive thereon to adhere to the second windup spool by the adhesive.

2. The process of claim 1, wherein said slitting wheel is mounted above the webbing and vertically displaceably for free rotation from a holder.

3. The process of claim 1, wherein said slitting wheel has a spike pin extending from its periphery, the process further comprising engaging said spike pin within said webbing for increased positive contact between said webbing and said slitting wheel in selective frictional engagement therewith.

4. The process of claim 3, wherein said establishing contact between said slitting wheel and said webbing comprises lowering said slitting wheel into contact with said webbing.

5. The process of claim 4, wherein said slitting wheel further comprises an internal weight attached to an interior periphery of the wheel for defining the resting position of said slitting wheel when it is out of contact with said webbing, and for defining the peripheral contact point of said slitting wheel when it is lowered into contact with said webbing.

6. The process of claim 5, wherein said internal weight is located in the direction of rotation of said slitting wheel before said spike pin, whereby upon said slitting wheel contacting said webbing, said spike pin comes into positive engagement with said webbing, and said slitting knife and said adhesive contact said webbing seriatim after contact thereof with said spike pin.

7. The process of claim 1, wherein said adhesive is attached to the circumference of said slitting wheel in the direction of rotation after said slitting knife.

8. The process of claim 7, further comprising an assistant rest sheet, and wherein said adhesive is a strip of adhesive tape one end of which is attached to the circumference of said slitting wheel, the other end of said adhesive tape being attached to said assistant rest sheet remotely from said slitting wheel.

9. The process of claim 1, wherein said adhesive is a tape having adhesive applied to both sides thereof.

10. In an apparatus for the uninterrupted winding of a continuous webbing onto a windup spool, which comprises, a rotatable feed drum for frictionally forwarding said continuous webbing from an upstream supply direction, secondary support arms, a first windup spool pushed by said secondary support arms into frictional rotary engagement with said feed drum for winding up the supplied webbing thereon, a blower moved into a discharging position for discharging a blast of air for selectively ripping said webbing and simultaneously blowing the resulting leading edge into engagement with a second windup spool, primary support arms, and said second windup spool supported by said primary support arms in a standby position for replacing said first windup spool when a predetermined amount of the webbing has been wound up onto said first windup spool, the improvement which comprises a rotatable slitting wheel having a periphery, said slitting wheel being mounted above said webbing for vertical displaceability selectively into and out of frictional contact with said webbing at a position when viewed from the supply direction upstream of said second windup spool, a lateral slitting knife attached from said periphery for selectively making a lateral slit in the lateral center of said webbing, and an adhesive attached from said periphery when viewed from the direction of rotation after said slitting knife for being transferred from said periphery to said webbing when viewed from the supply direction upstream of said lateral slit.

11. The apparatus of claim 10, further comprising a holder for vertically displaceably mounting said slitting wheel in a freely rotatable manner.

12. The apparatus of claim 10, further comprising a spike pin attached from said periphery for improving said frictional contact between said slitting wheel and said webbing.

13. The apparatus of claim 12, wherein said slitting wheel has an internal periphery, the apparatus further comprising a weight attached to said internal periphery at a location in the direction of rotation of said slitting wheel between said spike pin and said slitting knife, said weight being used for defining the resting position of said slitting wheel when it is out of contact with said webbing, and for defining the peripheral contact point of said slitting wheel when it is lowered into frictional contact with said webbing.

14. The apparatus of claim 10, wherein said adhesive is a tape having adhesive applied to both sides thereof.

15. The apparatus of claim 10, wherein said adhesive is a strip of adhesive tape, the apparatus further comprising an assistant rest sheet, one end of said tape being attached to the circumference of said slitting wheel, and the other end of said tape being attached to said assistant rest sheet remotely from said slitting wheel.

* * * * *